United States Patent [19]

Johnson

[11] Patent Number: 5,000,715

[45] Date of Patent: Mar. 19, 1991

[54] TOY MACHINE FOR LAYING A SIMULATED ROAD SURFACE

[75] Inventor: David W. Johnson, Jamestown, Ohio

[73] Assignee: Lawrence C. Vonderhaar, Cleves, Ohio

[21] Appl. No.: 428,105

[22] Filed: Oct. 27, 1989

Related U.S. Application Data

[63] Continuation of Ser. No. 340,378, Apr. 19, 1989, abandoned, which is a continuation of Ser. No. 87,110, Aug. 19, 1987, abandoned.

[51] Int. Cl.[5] ..... A63H 17/00; A63H 18/02

[52] U.S. Cl. ..... 446/427; 446/901; 238/10 B

[58] Field of Search ..... 446/427, 424, 431, 434, 446/465, 444, 470, 435, 475, 901

[56] References Cited

U.S. PATENT DOCUMENTS

| | | | |
|---|---|---|---|
| 1,829,963 | 11/1931 | Pettibone . | |
| 2,898,825 | 8/1959 | Walker et al. . | |
| 3,011,288 | 12/1961 | Einfalt . | |
| 3,421,252 | 1/1969 | Downey | 446/427 |
| 3,624,956 | 12/1971 | Villasana et al. . | |
| 3,780,235 | 12/1973 | Deyerl et al. . | |
| 4,107,811 | 8/1978 | Imsande . | |
| 4,227,335 | 10/1980 | Kuna et al. | 446/475 X |
| 4,236,950 | 12/1980 | Eigenmann . | |
| 4,245,756 | 1/1981 | Byrne et al. | 446/427 X |
| 4,395,843 | 8/1983 | Fichter et al. . | |
| 4,397,419 | 8/1983 | Fischer . | |
| 4,632,872 | 12/1986 | Galager et al. . | |

FOREIGN PATENT DOCUMENTS

| | | |
|---|---|---|
| 2735146 | 2/1979 | Fed. Rep. of Germany . |
| 2423246 | 4/1978 | France . |

*Primary Examiner*—Mickey Yu

*Attorney, Agent, or Firm*—Jacox & Meckstroth

[57] ABSTRACT

A temporary type of surface structure for use with toy vehicles. An elongate strip of flexible material has a front surface and a back surface. The front surface has the appearance of a road, or highway or street. The back surface is provided with adhesive or tacky material which is capable of attachment of the strip to a floor or the like and which is capable of frequent removal and reattachment of the strip to surfaces such as a floor or a carpet or the like, either indoors or out-of-doors. The invention also involves a toy machine which is capable of laying a strip of material upon a surface to simulate the construction of a road surface.

13 Claims, 3 Drawing Sheets

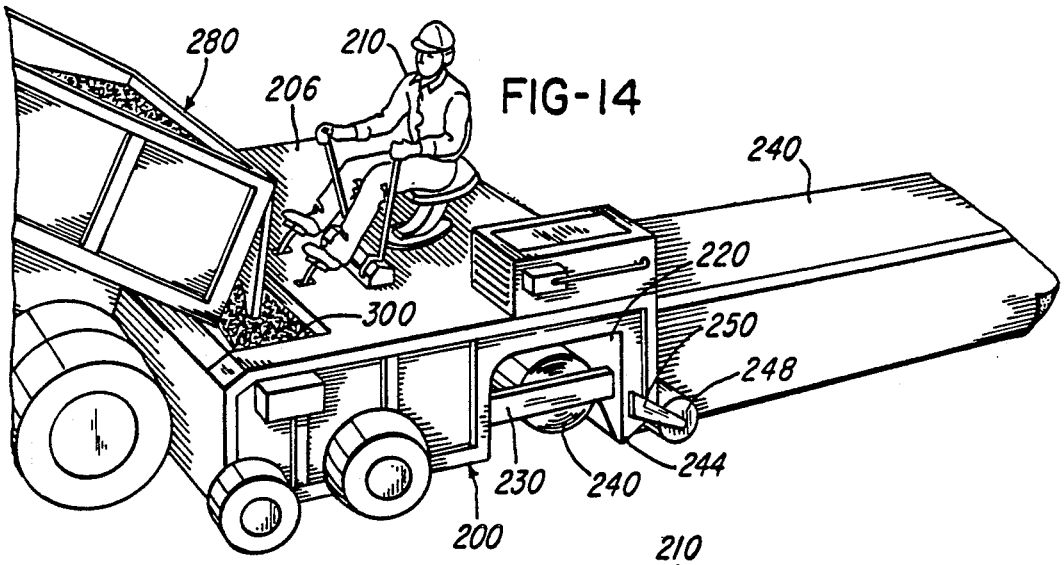
FIG-14
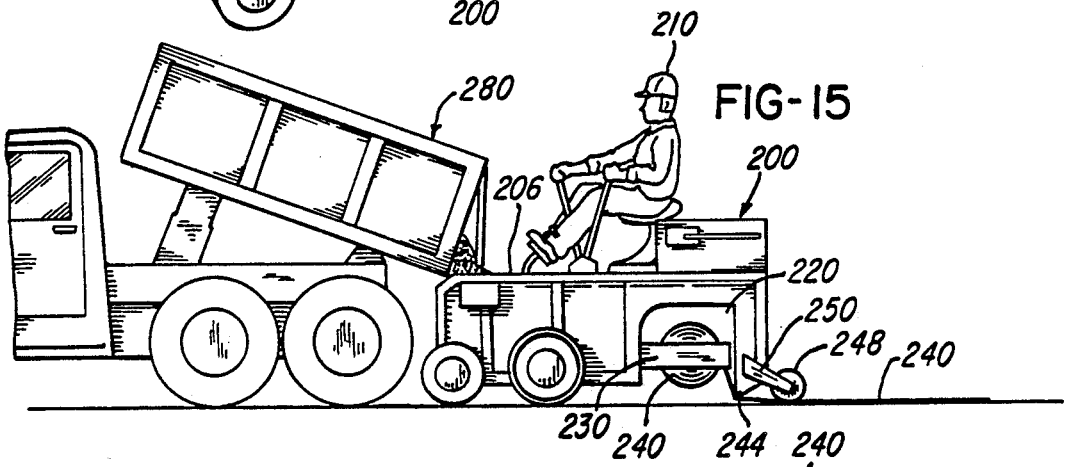
FIG-15
FIG-16
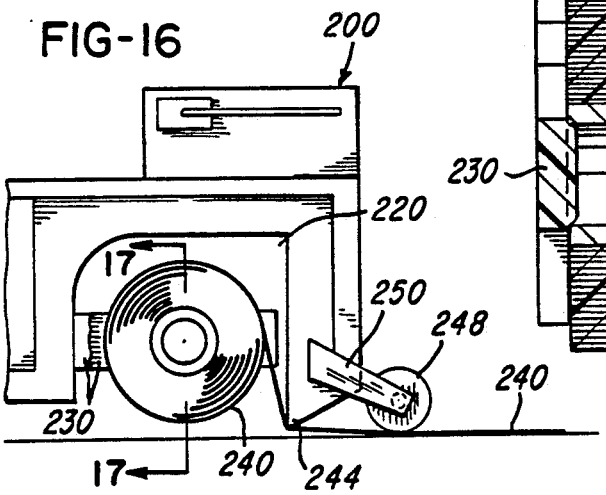
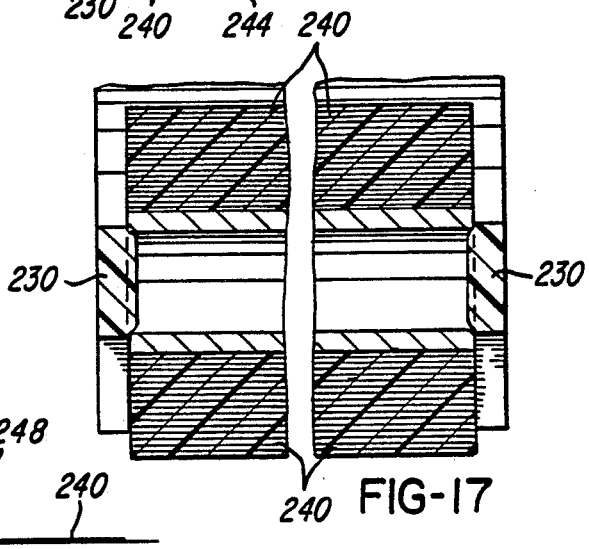
FIG-17

TOY MACHINE FOR LAYING A SIMULATED ROAD SURFACE

RELATED APPLICATION

This application is a continuation of application Ser. No. 07/340,378, filed Apr. 19, 1989, now abandoned, which is a continuation of application Ser. No. 07/087,110, filed Aug. 19, 1987, now abandoned.

BACKGROUND OF THE INVENTION

A child frequently finds the occasion to play with toy vehicles The child desires to operate a toy automobile upon a road or highway or parking lot The child desires to operate a toy airplane from a landing strip or the like. However, when the child is within the room of a house, the child has only a floor surface or carpet surface upon which to operate a toy vehicle However, a floor or carpet surface does not ordinarily have a portion which has the appearance of a road or highway or parking lot or landing strip. When the child is out-of-doors, a surface may not be available which has the appearance of a road for toy automotibles or a landing strip for toy airplanes.

It is therefore an object of this invention to provide a structure and method by which a simulated or realistically appearing road, or highway, or street, or parking lot, or landing strip, or the like can be supported by or a part of a floor or carpet or the like or any other suitable surface for use with toy vehicles.

It is another object of this invention to provide means by which realistic indicia, or signs, or markings, or the like can be attached to the simulated highway or parking lot or landing strip or the like for use with toy vehicles.

It is another object of this invention to provide a toy machine which is capable of applying a simulated road or highway surface to a floor or carpet for use with toy vehicles.

It is another object of this invention to provide such simulated road or highway structure which can be easily and readily attached to a carpet or floor for use with toy vehicles and which can be easily removed therefrom and reattached for additional use with toy vehicles.

Other objects and advantages of this invention reside in the construction of parts, the combination thereof, the method of construction and the mode of use, as will become more apparent from the following description.

SUMMARY OF THE INVENTION

This invention comprises structure and a method by which a simulated highway, road, parking area, or air strip can be laid down upon a floor or carpet or the like and temporarily attached thereto, for use by a child in playing with toy automobiles or airplanes or the like.

In this invention, an elongate flexible strip of material is provided with a back surface and a front surface. The back surface carries adhesive or tacky material for attachment of the strip of material to a floor or carpet or other surface, indoors or outdoors. The front surface is provided with markings and indicia which simulate those which appear on a highway, parking lot, or landing strip or the like The flexible strip of material may be paper or paper-like material, such as plastics material or the like The flexible strip of material may be of the nature of an adhesively backed tape, such as duct tape, or the like The flexible strip material may be dispensed from a roll thereof or from or by any other suitable dispenser means The markings or indicia may be painted upon the front surface or may be separate adhesively backed elements, such as turn signals, stop signals and the like, which are adhesively attached to the strip of material.

The strip of material is adapted to be adhesively attached to a carpet or floor or the like The adhesive or tacky material on the back surface of the strip is of the type which permits the strip to be attached and removed from the carpet or floor and then adhesively reattached to the carpet or floor at some later time.

This invention also includes a toy by which a strip of material can be laid down upon a carpet or floor in a manner which simulates a machine which applies a surface to a road or highway, or street.

Thus, this invention provides a simulated road or highway or street or parking lot or landing strip for temporary attachment to a carpet or indoor or outdoor floor for use by a child as the child plays with toy automobiles or airplanes. This invention also provides a toy machine for application of a simulated road or highway to a surface for use with toy vehicles.

BRIEF DESCRIPTION OF THE VIEWS OF THE DRAWINGS

FIG. 14 is a fragmentary perspective view, drawn on a larger scale than the other figures, illustrating a toy machine which applies a simulated highway or road to a surface, such as a floor or carpet, for use with toy vehicles.

FIG. 15 is a fragmentary side elevational view, drawn on a slightly smaller scale than FIG. 14, showing the toy machine of FIG. 14.

FIG. 16 is an enlarged fragmentary side view of a portion of the toy machine of FIGS. 14 and 15.

FIG. 17 is an enlarged sectional view taken substantially on line 17—17 of FIG. 16.

DETAILED DESCRIPTION OF THE INVENTION

Figure 1:
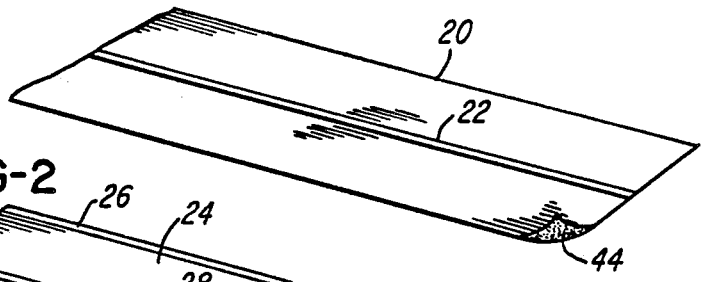
FIG. 1 is a fragmentary perspective view showing a portion of a strip of material which forms a simulated highway or road for use with toy vehicles.

In general terms, in accordance with this invention a simulated highway, or street, or road or strip for use with toy vehicles comprises an elongate strip of flexible material FIG. 1 shows a strip 20 of flexible material which has an upper surface which has the appearance of a road or highway. The strip 20 is provided with a central dividing line 22, which appears as a dividing line in a highway.

Figure 2:
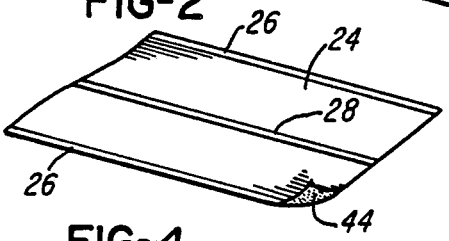
FIG. 2 is a fragmentary perspective view showing a portion of a strip of material which forms another type of simulated highway or road for use with toy vehicles.

FIG. 2 shows a strip 24 of flexible material which has an upper surface which simulates a road provided with edge lines 26 and a centerline 28.

Figure 3:
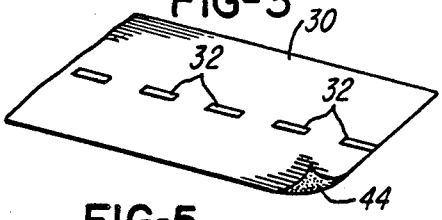
FIG. 3 is a fragmentary perspective view showing a portion of a strip of material which forms another type of simulated highway or road for use with toy vehicles.

FIG. 3 shows a strip 30 of flexible material which has ân upper surface which simulates a road which has a centerline 32 consisting of aligned dashes.

Figure 4:
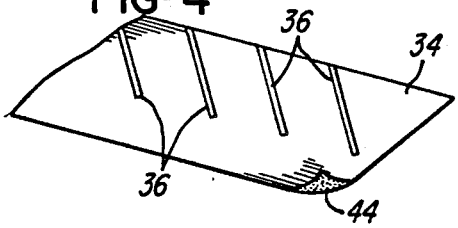
FIG. 4 is a fragmentary perspective view showing a portion of a strip of material which forms a simulated parking area for use with toy vehicles

FIG. 4 shows a strip 34 of flexible material which has an upper surface which has parking stripe lines 36.

Figure 5:
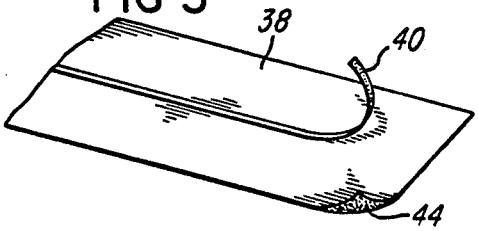
FIG. 5 is a fragmentary perspective view showing a portion of a strip of material which forms another type of simulated highway or road for use with toy vehicles. This view also illustrates an element for use in applying a dividing line or the like to a simulated highway or road.

FIG. 5 shows a strip 38 of flexible material which has an upper surface which has a removable centerline 40. The centerline 40 has adhesive material on the lower surface thereof and may be applied to and removed from the strip 38 as desired.

Figure 6:
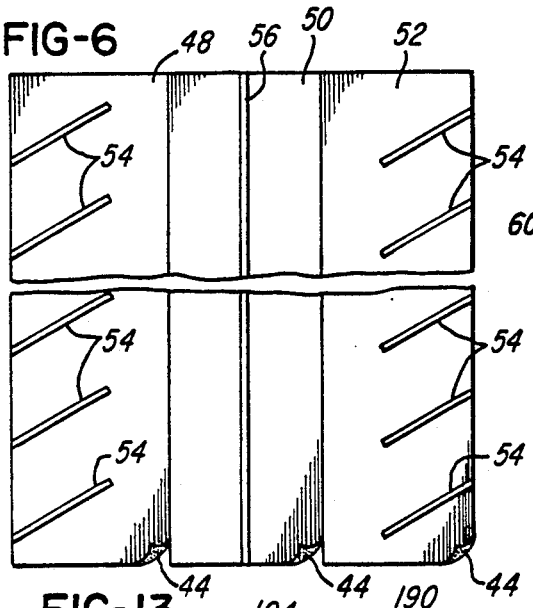
FIG. 6 is a fragmentary plan view illustrating a simulated parking lot constructed in accordance with this invention for use with toy vehicles.

FIG. 6 shows strips 48, 50, and 52 of flexible material which are laid side-by-side upon a surface The strips 48 and 52 have stripes 54, illustrating a simulated automobile parking area. The strips 48, 50, and 52 thus form a simulated parking lot. The strip 50 forms a driveway with a centerline 56 at the center of the parking lot.

Figure 7:
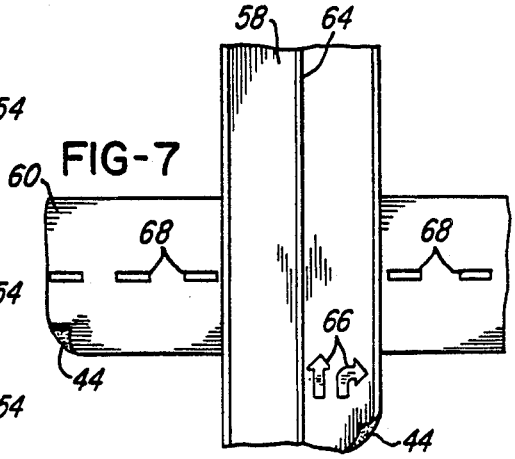
FIG. 7 is a fragmentary plan view illustrating a pair of simulated intersecting roads or highways constructed in accordance with this invention.

FIG. 7 shows a strip 58 of flexible material and a strip 60 of flexible material which are positioned at right angles to form two simulated intersecting streets or roads and in which the street formed by the strip 58 has a centerline 64 and also has turn indicator indicia 66. If desired, the turn indicator indicia 66 may be adhesively removably attached to the strip 58, or the turn indicator indicia 66 may be painted or printed upon the strip 58. The strip 60 has a dashed centerline 68.

Figure 8:
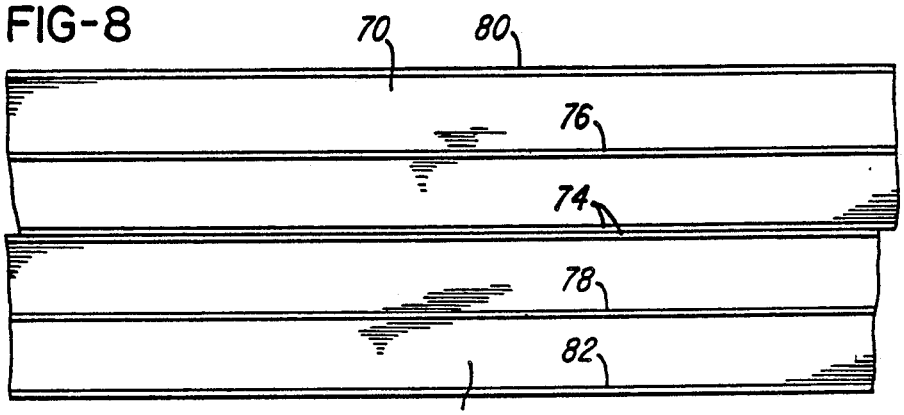
FIG. 8 is a fragmentary plan view illustrating another simulated highway constructed in accordance with this invention for use with toy vehicles.

FIG. 8 shows a strip 70 of flexible material and a strip 72 of flexible material which are positioned side-by-side to form a simulated four-lane highway, having a double centerline 74 and single centerlines 76 and 78, with edge lines 80 and 82.

Figure 9:
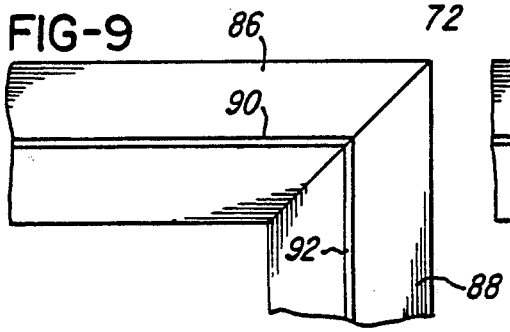
FIG. 9 is a fragmentary plan view illustrating an angular portion of a road constructed in accordance with this invention for use with toy vehicles.

FIG. 9 shows a strip 86 of flexible material and a strip 88 of flexible material which are juxtapositioned at a right angle to simulate a street or road which has a right angle turn and which is provided with a centerline 90 and a centerline 92.

Figure 10:
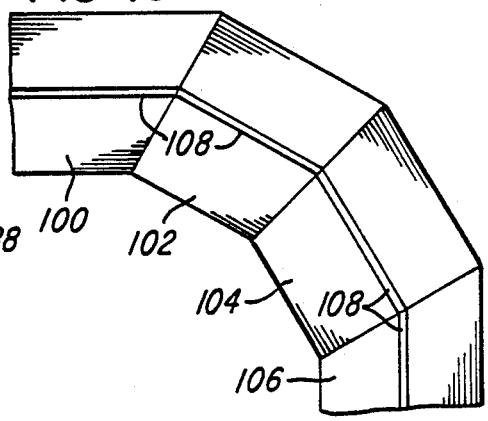
FIG. 10 is a fragmentary plan view illustrating a simulated curved portion of a road constructed in accordance with this invention for use with toy vehicles.

FIG. 10 shows flexible strip portions 100, 102, 104, and 106 which are arranged at angles to form a simulated curved road section provided with a centerline 108.

Figure 11:
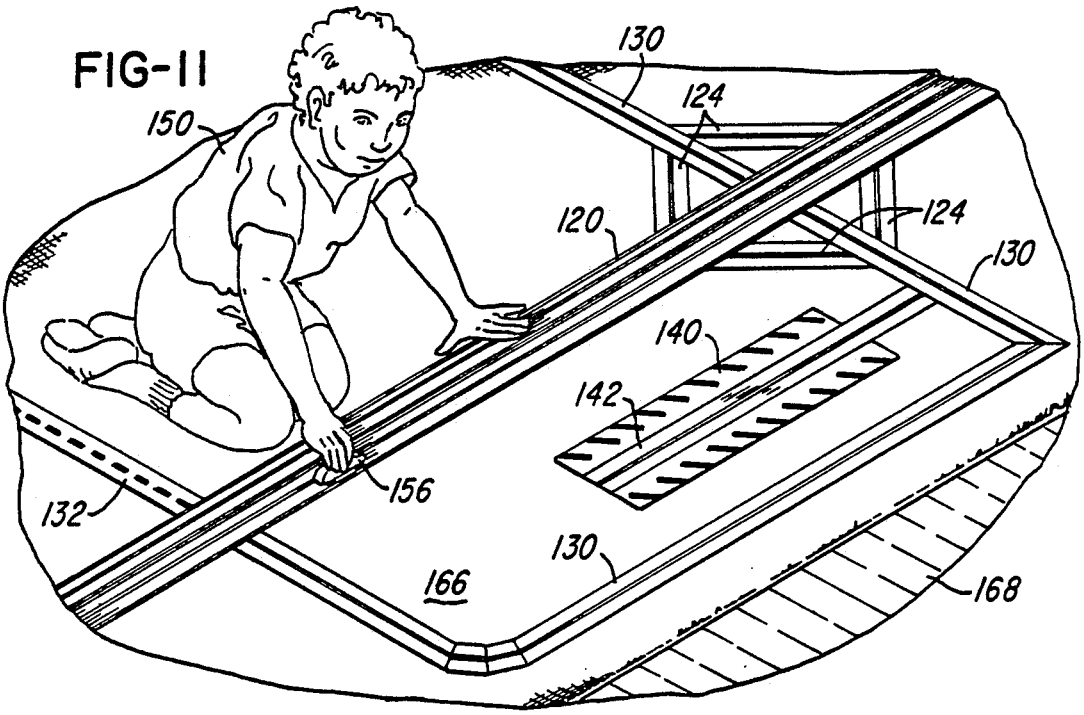
FIG. 11 is a fragmentary perspective view, drawn on a smaller scale than the other figures, illustrating a plurality of highways or roads or streets and a parking lot constructed in accordance with this invention and in use by a child with a toy vehicle.

FIG. 11 illustrates the use of strips of flexible material such as those shown in the other figures and discussed above. The strips are of such a nature and are so arranged to form a simulated super highway 120 and entrance and exit roads 124 FIG. 11 also shows strips arranged to form simulated roads 130 and 132. FIG. 11 also shows strips arranged to form a simulated parking lot 140, having a central driveway 142 A child 150 is shown with a toy vehicle 156, as the toy vehicle 156 moves upon the strips The strips are positioned upon any suitable surface 166, which may be a carpet or the like which covers a portion of a floor 168.

Figure 12:
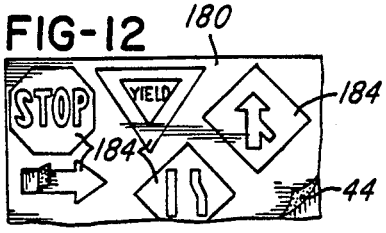
FIG. 12 is a fragmentary plan view illustrating a strip of material which releasably adhesively retains a plurality of indicia or signs or the like for application to a simulated road or highway made according to this invention.

FIG. 12 shows a strip 180 which has adhesively removably attached thereto a plurality of indicia elements 184 which simulate signs which appear on various highways. The elements 184 are removable from the strip 180 to strips such as those shown in FIGS. 1–11.

Figure 13:
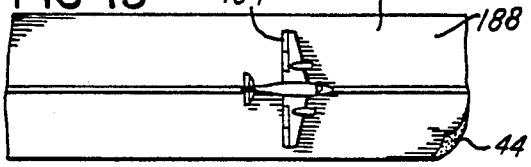
FIG. 13 is a fragmentary plan view drawn on substantially the same scale as FIGS. 1–10, showing a portion of a landing strip made in accordance with this invention for use with toy airplanes.

FIG. 13 shows a strip 188 which has a back surface provided with releaseable adhesive material 44 The strip 188 has a centerline 190 and has the general appearance of an aircraft landing strip. A toy airplane 194 is shown upon the strip 188.

Preferably, each of the strips shown in FIGS. 1–13 has adhesive or tacky material 44 on the lower surface thereof, which provides means by which the strips are releasably adhesively attached to a carpet or floor or other surface, indoors or out-of-doors Preferably, the adhesive material 44 is a tacky material which adheres to a surface, but which can be readily released from the surface The adhesive material 44 is also a material which can be reattached to a surface after removal from the same surface or from another surface.

Prior to laying the strips upon a surface, the strips can be wound in a roll or rolls thereof For example, the strip 60 may be wound in a roll and the strip 58 may be wound in another roll The strip 52 and the strip 48 may be wound in another roll For use, the strips of material can be removed from a roll or rolls thereof.

The strips shown in the figures thus can be reused several times prior to deterioration thereof. The strips are readily disposable after a plurality of uses. When a strip becomes worn it can be disposed of and replaced by a new strip which is removed from a roll thereof or from any other suitable dispenser.

FIGS. 14–17

FIGS. 14–17 illustrate a toy machine 200 which is employed to simulate a machine which is used in the construction of a road or highway or street. The toy machine 200 has an upper deck 206 upon which a toy man 210 serves to simulate an operator of the toy machine 200. The toy machine 200 has a rear recess portion 220, within which are support members 230 which rotatably support a roll of flexible strip material 240. The strip material 240 extends from the roll thereof and under a tapered portion 244 and under a roller 248 The roller 248 is supported by arms 250. Thus, as the toy machine 200 is moved along a surface, the strip 240 is laid down upon the surface as the strip 240 extends from the roll thereof. The strip 240, preferably, has tacky or adhesive material 260 on the lower surface thereof.

A toy truck 280 is shown in the act of simulating the dumping of material 300 into the toy machine 200 The material which enters the machine 200 simulates road surface material to be laid upon a surface to form a road, such as illustrated by the strip 240.

Thus, it is understood that this invention provides means and a method by which a child can establish a simulated road or highway or landing strip or parking lot on any suitable surface, such as a carpet or floor, either indoors or out-of-doors, for use in playing with toy vehicles. Furthermore, this invention provides a toy by which a child can construct a simulated road or street.

Although the preferred embodiment of the temporary surface structure for toy vehicles of this invention has been described, it will be understood that within the purview of this invention various changes may be made in the form, details, proportion and arrangement of parts, the combination thereof, and the mode of use, which generally stated consist in a structure and method within the scope of the appended claims.

The invention having thus been described, the following is claimed:

1. A toy machine for laying a simulated road surface upon a floor for use by a child while playing with toys upon the simulated road surface comprising a toy vehicle provided with rotatable wheels for travel upon a floor, the toy vehicle including a support member carried by the rotatable wheels, a roll of flexible strip material carried by the support member, the flexible strip material having a first surface which has the appearance of a road surface and a second surface which carries adhesive material, wherein the flexible strip material is extendable from the support member of the toy vehicle and is adhesively attachable to a floor as the toy vehicle travels upon the floor.

2. The toy machine of claim 1 in which the toy vehicle includes a road materials receptor portion which has the appearance of a road materials receptor portion of a conventional road surfacing machine.

3. The toy machine of claim 3 in which the support member of the toy vehicle includes an engagement part which is engaged by successive portions of the flexible strip material as successive portions of the flexible strip material extend from and move from the roll thereof for laying successive portions of the flexible strip material upon a floor.

4. The toy machine of claim 1 in which the support member of the toy vehicle has a lower part and in which the support member includes a tapered portion at the lower part of the support member, the tapered portion of the support member being engaged by the flexible strip material as the flexible strip material extends from the roll thereof for laying the flexible strip material upon a floor, and a roller attached to the support member of the toy vehicle adjacent the tapered portion, the roller being engaged by the flexible strip material for directing the flexible strip material from the toy vehicle to a floor upon which the toy vehicle travels and for attaching the flexible strip material to the floor.

5. The toy machine of claim 1 in which the support member of the toy vehicle has a recess portion within which the roll of flexible strip material is positioned, and a support shaft within the recess portion supporting the roll of flexible strip material.

6. The toy machine of claim 1 in which the second surface of the flexible strip material carries releasable and reattachable adhesive material.

7. The toy machine of claim 1 in which the first surface of the flexible strip material is provided with a continuous stripe along the length thereof, thereby providing a simulated road surface having a dividing line along the length thereof.

8. A toy machine for simulating the laying of a road surface by a conventional road surfacing machine, the toy machine being adapted to travel upon a floor, the toy machine including a body member provided with a support portion, flexible strip material carried by the support portion, the flexible strip material having a first surface and a second surface, the first surface having the appearance of a road surface, the second surface including adhesive material for attachment of the flexible strip material to a floor as the toy vehicle travels upon the floor.

9. The toy machine of claim 8 in which the body member of the toy machine includes engagement means for directing the flexible strip material from the body member to the floor.

10. The toy machine of claim 8 which includes a roller attached to the body member and engageable by the flexible strip material for directing the flexible strip material from the body member to the floor.

11. The toy machine of claim 8 in which the flexible strip material is in the form of a roll, and in which the support portion of the body member has a recess within which the roll of flexible strip material is positioned.

12. The toy machine of claim 8 in which the flexible strip material is in the form of a roll and in which the first surface of the flexible strip material has an elongate stripe extending along the length thereof.

13. The toy machine of claim 8 in which the second surface of the flexible strip material includes releasable and reattachable adhesive material.

* * * * *

UNITED STATES PATENT AND TRADEMARK OFFICE

CERTIFICATE OF CORRECTION

PATENT NO. : 5,000,715

DATED : March 19, 1991

INVENTOR(S) : David W. Johnson

It is certified that error appears in the above-identified patent and that said Letters Patent is hereby corrected as shown below:

Column 4, line 14, after "strips" insert a period (.).

Column 4, line 22, after "44" insert a period (.).

Column 4, line 31, after "out-of-doors" insert a period (.).

Column 4, line 34, after "surface" insert a period (.).

Column 4, line 38, after "thereof" insert a period (.).

Column 4, line 40, after "roll" insert a period (.).

Column 4, line 41, after "roll" insert a period (.).

UNITED STATES PATENT AND TRADEMARK OFFICE
CERTIFICATE OF CORRECTION

PATENT NO. : 5,000,715

DATED : March 19, 1991

INVENTOR(S) : David W. Johnson

It is certified that error appears in the above-identified patent and that said Letters Patent is hereby corrected as shown below:

Column 5, line 37, change "3" to---1---.
Column 1, line 13, after "vehicles" insert a period (.).
Column 1, line 14, after "lot" insert a period (.).
Column 1, line 18, after "vehicle" insert a period (.)
Column 1, line 64, after "like" insert a period (.).
Column 1, line 66, after "like" insert a period (.).
Column 1, line 68, after "like" insert a period (.).
Column 2, line 2, after "means" insert a period (.).
Column 2, line 8, after "like" insert a period (.).
Column 3, line 25, after "material" insert a period (.).
Column 3, line 45, after "surface" insert a period (.).
Column 4, line 9, after "124" insert a period (.).
Column 4, line 12, after "142" insert a period (.).

Signed and Sealed this

Fifteenth Day of September, 1992

*Attest:*

*Attesting Officer*

DOUGLAS B. COMER

*Acting Commissioner of Patents and Trademarks*